United States Patent [19]

Dodrill

[11] Patent Number: 4,841,953

[45] Date of Patent: Jun. 27, 1989

[54] AUXILIARY SUPPLY SYSTEM FOR A PORTABLE SELF-CONTAINED BREATHING APPARATUS

[76] Inventor: Gregg W. Dodrill, 7308 Campbell Rd., Dallas, Tex. 75248

[21] Appl. No.: 928,540

[22] Filed: Nov. 7, 1986

[51] Int. Cl.[4] ..... A62B 9/04

[52] U.S. Cl. ..... 128/202.27; 128/204.26; 128/205.24; 128/205.25

[58] Field of Search ..... 128/202.27, 204.26, 128/204.27, 205.24, 201.28, 201.27, 206.15, 207.12, 201.23

[56] References Cited

U.S. PATENT DOCUMENTS

| | | | |
|---|---|---|---|
| 2,839,054 | 6/1958 | Kindred | 128/204.26 |
| 3,202,150 | 8/1965 | Miller | 128/202.27 |
| 3,308,815 | 3/1967 | Wilcox et al. | 128/202.27 |
| 3,456,642 | 7/1969 | Cupp | 128/204.29 |
| 4,111,342 | 9/1978 | Kirby | 128/202.27 |
| 4,377,163 | 3/1983 | Feathers | 128/205.22 |
| 4,392,490 | 7/1983 | Mattingly et al. | 128/205.25 |
| 4,559,939 | 12/1985 | Levine et al. | 128/202.27 |
| 4,619,255 | 10/1986 | Spinosa et al. | 128/202.27 |

*Primary Examiner*—Edward M. Coven
*Assistant Examiner*—K. M. Reichle
*Attorney, Agent, or Firm*—Warren B. Kice

[57] ABSTRACT

An auxiliary supply system for a portable self-contained breathing apparatus in which an auxiliary source of air is provided to the facepiece which is totally independent of the normal air supply, in order to provide additional air to the user in case the original supply of air runs out or any component of the standard breathing apparatus malfunctions.

4 Claims, 1 Drawing Sheet

AUXILIARY SUPPLY SYSTEM FOR A PORTABLE SELF-CONTAINED BREATHING APPARATUS

BACKGROUND OF THE INVENTION

This invention relates to an portable self-contained breathing apparatus and, more particularly, to an auxiliary supply system for providing an alternate source of air for said apparatus.

Portable self-contained apparatus breathing systems are well known in the art and are normally designed for use in hazardous atmospheres such as fires, smoke, and the like or, alternatively, in underwater applications such as scuba diving and deep sea diving. These known devices normally utilize a portable cylinder of pressurized air which is strapped to the user's back and connected, via a hose, to a breathing apparatus associated with a facepiece worn by the user. Upon release of the air from the air cylinder, air is transported into the interior of the facepiece. Normally a demand system is utilized which includes a valve responsive to breathing of the user for controlling the flow of air into the interior of the facepiece.

However, these type arrangements suffer from two major defects. One, they have a finite, somewhat limited, supply of air which limits their use to a relatively short time. Two, in the event of malfunction of any of the basic components of the apparatus, including the air cylinder, the mask, the control valve, and the hoses, the supply of the air to the user is terminated, with potentially disastrous results.

SUMMARY OF THE INVENTION

It is therefore an object of the present invention to provide a self-contained breathing apparatus which has a redundant air supply for use when the primary air supply is exhausted, or when there is a malfunction of the primary equipment.

It is a further object of the present invention to provide an auxiliary supply system for use in connection with a self-contained breathing apparatus in which a auxiliary supply of air is provided upon demand.

It is a further object of the present invention to provide an auxiliary supply system of the above type which is operated independently of the primary breathing apparatus.

Toward the fulfillment of these and other objects, the supply system of the present invention comprises an additional source of air, and an adapter unit connected to the facepiece of the primary air system for supplying the auxiliary source of air to the interior of the facepiece upon demand while permitting the primary breathing system to operate normally.

DESCRIPTION OF THE DRAWINGS

The above brief description, as well as further objects, features and advantages of the present invention will be more fully appreciated by reference to the following detailed description of the presently preferred but nonetheless illustrative embodiment in accordance with the present invention when taken in conjunction with the accompanying drawing wherein.

DESCRIPTION OF THE PREFERRED EMBODIMENT

Figure 1:
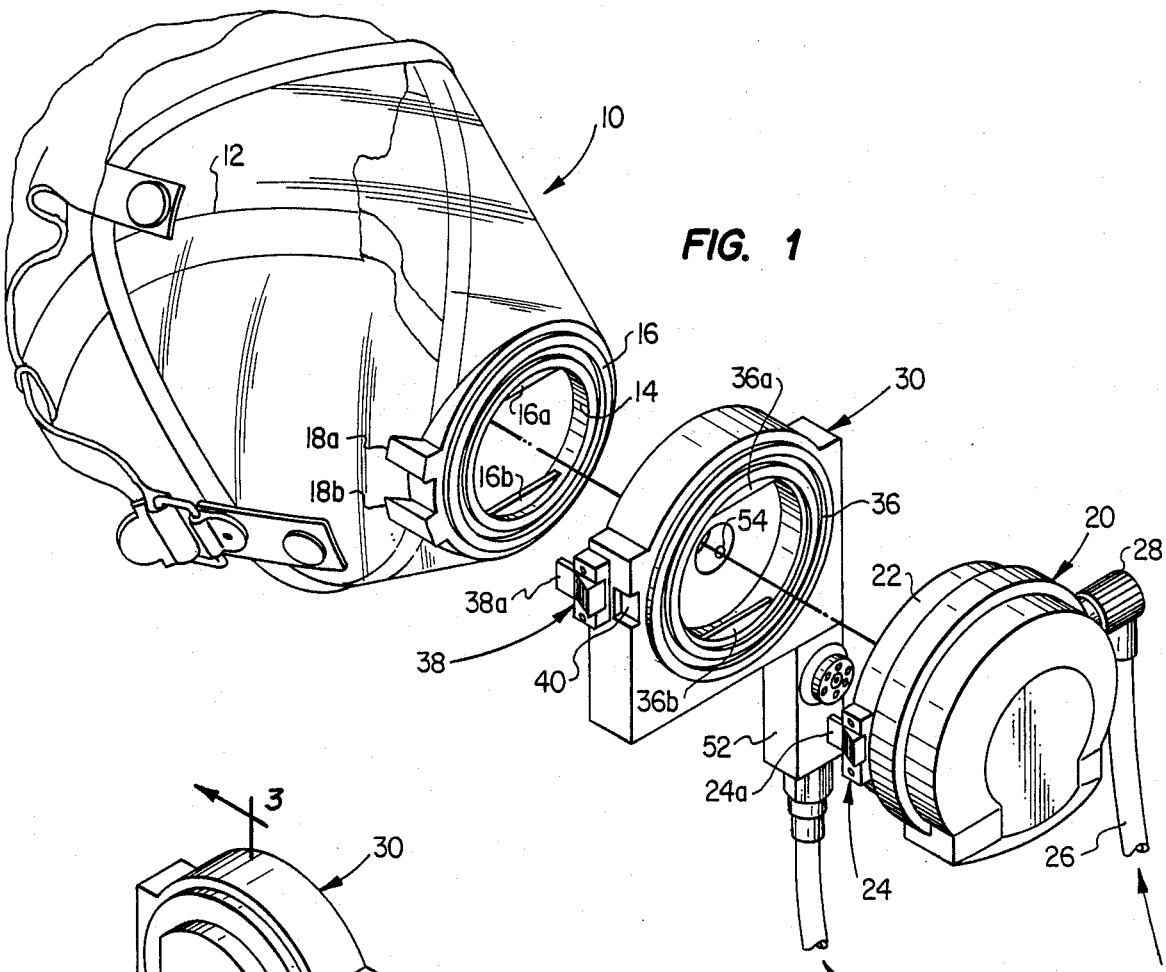
FIG. 1 is an exploded perspective view depicting the auxiliary supply system of the present invention shown with a primary air breathing apparatus.

Referring specifically to FIG. 1 of the drawings, the reference numeral 10 refers in general to a cone-shaped facepiece which can be constructed of a plastic, translucent material. A head harness, shown in general by the reference numeral 12, extends over the back portion of the facepiece to secure the facepiece on the user with the user's mouth registering with an opening 14 formed through the front end of the facepiece. A locking mechanism 16 is provided on the exterior front portion of the facepiece immediately adjacent the opening 14, and includes a pair of flanges **16*a* and 16*b* formed in the opening 14. A pair of flanges 18*a* and 18*b* are formed on the side of the facepiece 10 adjacent the opening 14** for reasons to be described in detail later.

A pressure regulator 20 is provided which includes a locking mechanism 22 designed to operatively engage the locking mechanism 16 to secure the pressure regulator in the opening 14. Although not clear from the drawings, it is understood that the locking mechanism 22 includes a protruding rectangular portion which is sized to fit to flanges **16*a* and 16*b* in the opening 14 so that, after insertion and rotation of the pressure regulator 20 a quarter turn, the protruding rectangular portion will extend inside the flanges 16*a* and 16*b* and the pressure regulator 20 will be locked relative to the facepiece 10. A latching assembly 24 is formed on the outer periphery of the pressure regulator 20 and includes a spring-loaded latch member 24*a* which is manually retracted during the aforementioned rotation and then allowed to project into the groove between the flanges 18*a* and 18*b* to secure the pressure regulator 20 relative to the facepiece 10**.

One end of a hose 26 is connected to the pressure regulator, via a coupling 28, and the other end to a source of compressed air (not shown) which preferably is in the form of a cylinder adapted to be carried by the user. In normal operation, the air cylinder, when fully charged can contain approximately 40 to 50 cubic feet of air at a pressure slightly in excess of 2200 psi which will supply air under normal circumstances for approximately 30 minutes. A pressure reducer (not shown) can be provided which is connected between the hose 26 and the air cylinder to reduce the pressure to approximately 200 psi before it enters the pressure regulator 20.

The pressure regulator 20 is adapted to maintain a positive pressure within the facepiece and, as such, normally would contain a diaphragm-operated valve which controls the flow of air from the hose 26 through the regulator in response to the breathing of the user. As stated above, the pressure regulator 20 is normally connected directly to the facepiece 10 by engaging the locking mechanism 22 of the pressure regulator into the locking mechanism 16 of the facepiece in the manner described above. Thus, in response to breathing of the user, the aforementioned diaphragm would operate the valve and allow the air from the hose 26 to pass into the interior of the facepiece for use by the user.

Figure 2:
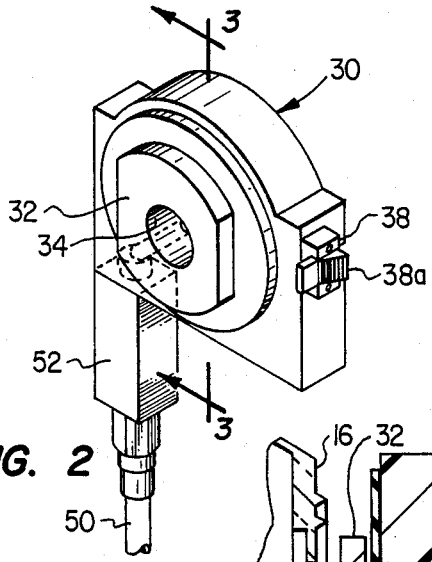
FIG. 2 is a perspective view of the adapter member of the auxiliary supply system of the present invention.
Figure 3:
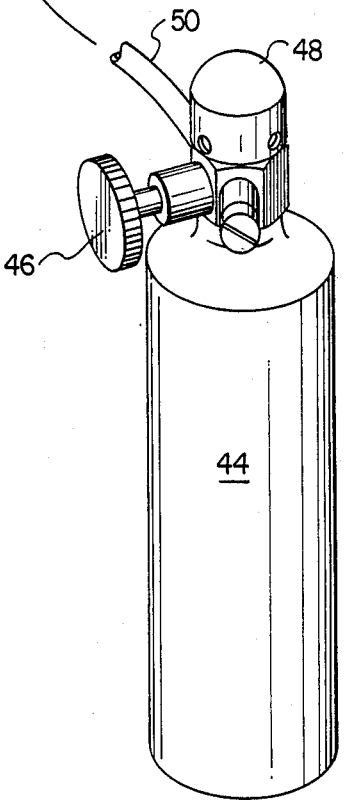
FIG. 3 is an enlarged cross-sectional view taken along the line 3—3 of FIG. 2.
Figure 3:
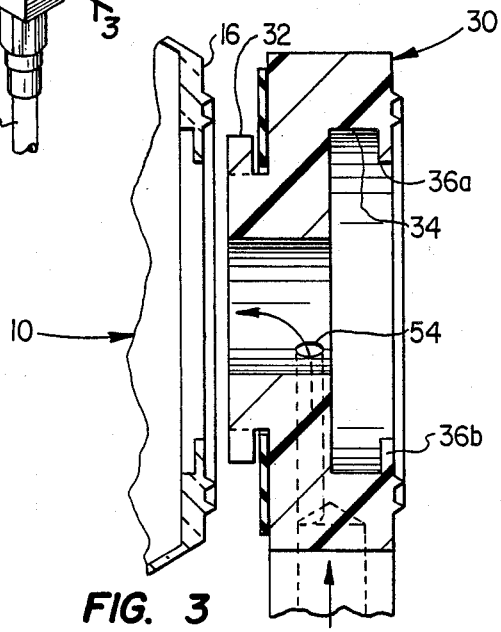

The components thus described are conventional and are designed to be operated in conjunction with the auxiliary system of the present invention which includes an adapter member 30 which is shown in FIG. 1 in its position relative to the conventional components just described and is shown in greater detail in FIGS. 2 and 3. The adapter member 30 includes a substantially rectangular protrusion 32 (FIG. 2) which is identical to the rectangular protrusion forming the locking mechanism 22 of the pressure regulator 20, and is adapted to extend between the flanges 16*a* and 16*b* in the opening 14 of the facepiece 10 in the same manner as discussed above.

The adapter member 30 has an axial opening 34 formed therethrough and includes a locking mechanism 36 which is formed by two flanges 36*a* and 36*b* disposed in the later opening and defining a rectangular opening identical to the opening defined by the flanges 16*a* and 16*b*. Thus the locking mechanism 36 is adapted to receive the locking mechanism 22 of the pressure regulator 20 in the manner described above. A latching mechanism 38 is formed on the side of the adapter member 30 adjacent the opening 34 and includes a spring-loaded latch member 38*a* for engaging between the flanges 18*a* and 18*b* on the facepiece 10 to secure the adapter member in a locked position relative to the facepiece. A notch 40 is also formed on the side of the adapter member 30 adjacent the latching mechanism 38 for receiving the latch member 24*a* of the latching mechanism 24 of the pressure regulator 20. The adapter member 30 can thus be secured onto the facepiece 10 by aligning the protrusion 32 with the opening defined by the flanges 16*a* and 16*b*, rotating same and allowing the latching member 38*a* to extend within the flanges 18*a* and 18*b* as discussed above. The adapter member 30, thus secured to the facepiece 10, can then receive the pressure regulator 20 by inserting the protrusion of the later into the opening defined by the flanges 36*a* and 36*b* and engaging the latch member 24*a* of the mechanism 24 in the notch 40.

The auxiliary system of the present invention also includes an air cylinder 44 which is smaller than the primary air cylinder associated with the pressure regulator 20 but which contains a sufficient volume of breathing air to allow breathing for a relatively short time sufficient to permit the user to exit from a hazardous environment. Toward this end, an on-off knob 46 is provided at the upper end portion of the cylinder 44 for the user to actuate to supply the air. A pressure reducer 48 is provided in the upper end portion of the cylinder 44 and is connected, via a hose 50 to a valve 52 secured at the lower portion of the adapter member 30. The pressure reducer 48 functions to reduce the pressure of the air contained in the cylinder 44 to a predetermined value such as 200 psi, and the hose 50 supplies this relatively low pressure air to the valve 52. It is understood that the valve 52 includes a diaphragm which is responsive to breathing of the user for actuating a valve to regulate air flow through the valve in the same manner as the regulator 20. Since the diaphragm and the valve are conventional they will not be described in any further detail.

The adapter member 30 is provided with an internal radial opening 54 extending from an exterior wall portion into the opening 34 which receives the regulated air from the valve 52 and introduces it into the opening 34 for passage into the interior of the facepiece 10 and consumption by the user. Since the valve 52 can be secured to the adapter member 30 in any known manner the connection will not be described in any further detail.

In operation, the adapter member 30 is secured to the facepiece 10 and the pressure regulator 20 is secured to the adapter 30 in the manner disclosed above. In normal operation, air from the primary air cylinder passes through the pressure reducer connected to the latter cylinder and then, via the tube 26, into and through the pressure regulator 20, into and through the adapter member 30, and into the interior of the facepiece. The regulating valve of the pressure regulator 20 controls the flow of air in response to the breathing of the user of the mask and as long as a supply of air from the primary cylinder is available, the adapter member 30 is inoperative.

When the primary source of air is exhausted and/or if there is malfunction in the primary components including the air cylinder, the pressure reducer, the hose 26, or the pressure regulator 20, the user can simply actuate the on-off knob 46 to supply air from the cylinder 44, via the hose 50 to the valve 52. The valve 52 operates to control the flow of air into and through the passage 54 and the opening 34 in the adapter member 30 in response to breathing of the user, whereupon the air flows into the interior of the facepiece 10 for consumption by the user. Thus the added volume of air, and therefore breathing time, made possible through the auxiliary system of the present invention allows the user to exit the area containing the hazardous air, or the like.

It is thus seen that several advantages result from the foregoing. For example, the present invention provides a self-contained breathing apparatus which has a redundant air supply for use when the primary air supply is exhausted or when there is a malfunction of the primary equipment. Also, the present invention provides an auxiliary supply system for use in connection with a self-contained breathing apparatus in which an auxiliary supply of air is provided upon demand when required. In addition, the present invention provides an auxiliary supply system of the above type which is operated totally independent of the primary breathing apparatus.

It is understood that several variations can be made in the foregoing without departing from the scope of the invention.

For example, the connection of the auxiliary source of air from the air cylinder 20 does not have to be made through the opening 14 in the facepiece 10 but rather can be made through an auxiliary opening formed through another portion of the facepiece. In this case, the pressure regulator 20 would be connected to the opening 14 in the conventional manner described above and the auxiliary air from the cylinder 44 would be supplied directly into the facepiece 10 through the auxiliary opening. A valve, similar to the valve 52 would be provided to control the air flow in the manner described above.

Accordingly to another embodiment of the present invention, the conventional pressure regulator 20 can be modified to accept an auxiliary source of air by connecting a tube, similar to the tube 50 from the air cylinder 44 directly to the pressure regulator 20. In this case, the pressure regulator 20 would be connected directly to the opening 14 in the facepiece and separate valves would selectively control the air from the primary source into the pressure regulator and into the interior of the facepiece 10, or from the auxiliary source of air into the pressure regulator and into the facepiece.

Still another alternative embodiment of the present invention is adapted for use with systems having a pressure regulator mounted on the belt or backpack of the user and a hose connecting the pressure regulator to the interior of the facepiece. In this case an adapter member, similar to the adapter member 30, would extend between the conventional pressure regulator and the above-mentioned hose and would be connected to an alternate air source for supplying additional air in the manner described above.

Other modifications, changes and substitutions are intended in the foregoing disclosure and, in some instances, some features of the invention can be employed without a corresponding use of other features. Accordingly, it is appropriate that the appended claims be construed broadly and in a manner consistent with the spirit and scope of the invention therein.

What is claimed is:

1. A portable breathing apparatus including a facepiece, a source of pressurized air, a pressure regulator, and first connecting means for connecting said facepiece to said regulator and second means for connecting said regulator to said air source for supplying air from said source into the interior of said facepiece under control of said regulator in response to demands by the user of said facepiece; wherein the improvement comprises a housing, third connecting means formed on said housing for cooperating with said first connecting means to connect said housing between said facepiece and said regulator, first passage means extending through said housing for permitting air from said source to pass into the interior of the facepiece, an additional source of pressurized air, means connecting said additional air source to said housing, second passage means formed in said housing for permitting air from said additional source to pass into the interior of the facepiece, and valve means disposed on said housing for controlling the flow of air through said second passage means.

2. The improvement of claim 1 wherein said first connecting means includes first locking means on said facepiece and second locking means on the regulator for engaging said first locking means; and wherein said third connecting means comprises third locking means identical to said second locking means for engaging said first locking means, and fourth locking means identical to said first locking means for receiving said second locking means.

3. The improvement of claim 1 wherein said valve means controls the flow of air from said additional air source and into said facepiece in response to breathing demands of the user of the facepiece.

4. The improvement of claim 1 wherein said valve means controls the flow of air from said additional air source into and through said second passage means without disengaging any of said connecting means.

* * * * *